US005839668A

United States Patent [19]

Varney et al.

[11] Patent Number: 5,839,668

[45] Date of Patent: Nov. 24, 1998

[54] MICRO-SPACER METERING APPARATUS EMPLOYING MULTI-CAVITY DISC AND PNEUMATIC EJECTION HEAD FOR FLAT PANEL DISPLAY ASSEMBLY

[75] Inventors: John C. Varney, Indialantic; Judson P. Costas, Port St. Lucie; Paul R. Nemeth, Melbourne; Ty R. Olmstead, Palm Bay, all of Fla.

[73] Assignee: Accudyne Corporation, Palm Bay, Fla.

[21] Appl. No.: 593,734

[22] Filed: Jan. 29, 1996

[51] Int. Cl.[6] ..... B05B 5/00

[52] U.S. Cl. ..... 239/690; 239/705; 118/308

[58] Field of Search ..... 239/690, 705, 239/654, 4; 118/308; 427/182; 406/67, 68; 222/368, 637

[56] References Cited

U.S. PATENT DOCUMENTS

| | | | |
|---|---|---|---|
| 4,302,481 | 11/1981 | Ribnitz et al. | 427/27 |
| 4,319,717 | 3/1982 | Hofmann | 239/654 |
| 4,780,028 | 10/1988 | McLemore | 406/68 |
| 5,109,893 | 5/1992 | Derby | 222/368 |
| 5,213,271 | 5/1993 | Uribe et al. | 239/654 |
| 5,240,185 | 8/1993 | Kaiju et al. | 239/690 |
| 5,615,830 | 4/1997 | Matsunaga et al. | 222/368 |

*Primary Examiner*—Andres Kashnikow
*Assistant Examiner*—Lisa Ann Douglas
*Attorney, Agent, or Firm*—Charles E. Wands

[57] ABSTRACT

A flat panel display spacer metering apparatus comprises a motor-driven rotatable disc, having a plurality of cavities distributed around a first surface of the disc. As the disc is rotated, its cavities are filled with spacers from a storage and fill device, configured as a hollow cylinder installed in a bore of a metering block. To facilitate transfer of spacer elements stored in the storage cylinder into cavities in the disc, an axially biased plunger continuously pushes the spacer elements against the first surface of the disc. As a result, whenever rotation of the disc exposes one or more of its cavities to the open end of the cylinder, spacers are forced into and fill the cavities. As the disc is further rotated and successive ones of its cavities are filled with spacers, the filled cavities are brought into alignment with a spacer element ejection head. The ejection head continuously directs a fluid, such as dry nitrogen gas against the cavity-containing surface of the disc. As a result, when a respective cavity becomes aligned with the fluid entry port, the forced gas supplied is directed into that cavity and forces all of the spacer elements within that cavity into an exhaust port, which is coupled to the electrostatic spray gun.

16 Claims, 5 Drawing Sheets

MICRO-SPACER METERING APPARATUS EMPLOYING MULTI-CAVITY DISC AND PNEUMATIC EJECTION HEAD FOR FLAT PANEL DISPLAY ASSEMBLY

FIELD OF THE INVENTION

The present invention relates in general to the manufacture of precision geometry components and devices, such as flat panel displays, and is particularly directed to a micro-spacer metering apparatus, by way of which micro-sized (e.g., 4–6 micron) precision spacer elements, such as spheres or rods that are employed for the manufacture of flat panel display devices are supplied to an electrostatic spray gun, which disperses a predefined number of spacer elements onto the surface of a flat panel member to achieve a prescribed spatial distribution and density of deposited spacers.

BACKGROUND OF THE INVENTION

The manufacture of precision geometry components and devices, such as flat panel displays, often involves the application or deposition of precision dimension-defining elements onto the surface of a workpiece or substrate, so that the applied elements may establish an offset or differential spacing for one or more additional members to be precision mounted relative to the workpiece surface.

As a non-limiting example, during the manufacture of a flat panel display diagrammatically illustrated in FIG. 1, in order to achieve a precision micro-spacing or differential offset 10 (on the order of only several microns) between first and second flat panel or substrate members 12 and 14, a plurality of (micro-sized, spherically shaped) spacer elements 16 (typically made of glass or polymer material) are uniformly dispersed between mutually adjacent surface areas 22 and 24 of the respective panel members 12 and 14. In the completed assembly, the precision spaced panel members are joined together along their peripheries by a sealing material 18.

In order to precisely control the distribution density of the spacer elements 16 over their intended coverage area between panel members 12 and 14, an electrostatic deposition apparatus of the type generally diagrammatically illustrated in FIG. 2 may be employed. As shown therein, a flat panel member upon which spacer elements are to be distributed, such as the flat panel member 12 of FIG. 1, is mounted to a flat metallic substrate or support member 33 (such as an aluminum plate) within an electrostatic deposition chamber 35. The spacer elements 16 are applied by means of an electrostatic spray gun 41, which is supported at the top of the deposition chamber's housing directly above the support substrate 33 upon which the panel member 12 has been placed, and is operative to effect a spray-dispersion of a given quantity of the (glass) micro-sphere spacers 16 into an electrostatic field 43 established over the area of the support member 33 by means of a plurality of field shaping or focussing rods 45 within the deposition chamber 35. In order for the deposited micro-sphere spacers 16 to have the intended spatial density on panel member 12, a spacer metering device 51 is used to supply electrostatic spray gun 41 with a predetermined number of spacer elements.

One type of metering device currently employed for this purpose is diagrammatically illustrated in FIG. 3 as comprising a cylinder 61 having a depression 63 sized to store a precise number of spacer elements to be supplied to the spray gun. In order to fill the depression 63, the cylinder 61 is positioned directly beneath a storage hopper 65 having a spacer exit aperture 67. Vibration of the storage hopper 65 causes spacer elements 16 to be released or spilled through the aperture 67 and deposited within the depression 63 in the cylinder 61. Once the depression 63 has been filled (to overflowing), the cylinder 61 is axially translated along arrow 68 past a scraper blade 71 having a curved aperture 73 that conforms with the outer diameter of cylinder 61. The scraper blade 71 serves to remove excess spacer elements into a waste bin (not shown), so that the number of spacer elements remaining in depression 63 will be as close as possible to a predefined number of spacers, as determined by the size of the depression 63 and the size of each spacer 16. Once the spacer filled cylinder 61 has been withdrawn past the scraper blade 71, the cylinder is rotated 180° about its axis, thereby inverting the spacer-filled depression 63 and allowing the spacer elements 16 to drop by gravity into an input 75 feed to an electrostatic spray gun 41.

Unfortunately, the spacer metering device of FIG. 3 suffers from a number of shortcomings. The most serious is the number of spacers that are wasted in the course of filling the depression 63 by means of the vibrating hopper 65 and scraper blade 71, with the number of unused spacers typically being as high as 50%, making the system very expensive. Secondly, the number of spacers within the depression 63 will vary from one filling operation to another, so that the number of spacers dispersed by spray gun 41 will vary from display to display, resulting in a non-uniformity of quality of finished products. In addition, the configuration of the storage hopper exposes the spacers to ambient moisture, which is undesirably absorbed into the spacer material.

FIG. 4 diagrammatically illustrates another type of spacer metering device, that comprise a large spacer storage container 81, containing a mass quantity 82 of spacers 16 and in which a spacer pick-up wheel or cylinder 83 rotates about an axis 84. In an effort to reduce non-uniformity in the number of metered spacers that results from using a single spacer capture element, such as is the depression 63 in the cylinder 61 of the metering device of FIG. 3, in the metering device of FIG. 4, the spacer pick-up wheel 83 has a plurality of serrations or grooves 85, each of which is sized to store a given number of spacer elements 16, less than the total number to be supplied to the spray gun.

To fill each groove 85, the pick-up wheel 81 is rotated through the mass 82 of spacers 16, causing spacers to enter the serrations 85, which then pass by a scraper blade 87 to remove excess spacer elements, that fall back into the mass 82, so that the number of spacer elements in each groove 85 will be as close as possible to a predefined number that is determined by the size of the grooves and the size of each spacer. As the spacer pick-up cylinder 61 is further rotated about its axis the filled grooves 85 are brought adjacent to a vacuum port 91, which draws the spacers 16 out of the grooves and into a supply conduit 93 to the electrostatic spray gun.

Because each of the serrations 85 of the metering device of FIG. 4 supplies only a portion of the total number of spacers to be deposited by the spray gun, individual errors in the target quantity of spacers per groove are effectively compensated by the average of the errors for the total number of grooves employed to meter an overall target number of spacers to the spray gun. Thus, contrasted with the metering device of FIG. 3, the arrangement of FIG. 4 provides improved uniformity of the number of metered spacers. However, because it requires a large spacer storage container 81, containing a mass quantity 82 of spacers 16, the device of FIG. 4 is expensive to use.

SUMMARY OF THE INVENTION

In accordance with the present invention, the shortcomings of conventional spacer metering schemes of the type described above with reference to FIGS. 3 and 4, are effectively obviated by a new and improved apparatus for supplying an accurately measured quantity of micro-sized spacer elements to a dispersing device, which minimizes exposure of the spacer elements to the atmosphere, effectively prevents spacer overfill and spillage so as to avoid wastage, thereby reducing cost, and also achieves a repeatable and therefore improved uniformity of the quantity of metered spacers to the spacer dispersion device (electrostatic spray gun).

For this purpose, the particulate spacer metering apparatus of the present invention comprises a rotatable disc, one surface of which has a plurality of cavities distributed in a circular pattern around the axis of rotation of the disc. The disc is incrementally and rotatably driven by means of an electric drive motor under the control of an associated metering control processor or micro-controller. A respective cavity has a conically tapered circular sidewall, which facilitates removal of micro-sphere shaped spacers by directing a fluid (such as compressed nitrogen or other dry gas) into the cavity.

Successive cavities in the circular distribution of cavities in the disc are filled with spacers by means of a spacer storage and fill device, which is preferably configured as a hollow cylinder installed in a bore of a metering block, and having an axis parallel to the axis of rotation of the disc and intersecting its circular pattern of cavities. The storage cylinder has an open end inserted into a cylindrical sleeve made of low friction material and positioned immediately adjacent to the disc, so that the spacing between the sleeve and the disc surface in which the cavities are formed, is less than the diameter of a spacers. Since the sleeve is made of low friction material, it may touch or abut against the disc, and serves to prevent leakage or spillage of spacers stored within the interior of the spacer storage cylinder.

The interior diameter of the spacer storage hollow cylinder may be the same as or slightly greater than that of an individual cavity or it may encompass a plurality of cavities, so that, as the disc is rotated, one or more of the cavities will be brought into mutually overlapping juxtaposition with the open end of the spacer storage cylinder, thereby exposing the one or more cavities in the disc to the spacer elements stored in the cylinder.

To facilitate transfer of spacer elements in the storage cylinder into one or more of the exposed cavities in the disc, a plunger axially biased by an associated pneumatic cylinder is inserted into a second end of the cylinder and is continuously axially pressed against the quantity of spacers stored in the cylinder, whereby the biased stored spacers will be continuously pushed against the first surface of the disc. As a result of this axial pressing of the spacers stored in the cylinder against the cavity-containing surface of the disc, then whenever rotation of the disc exposes one or more of its cavities to the open end of the cylinder, spacers will be forced into and fill the exposed cavities. In order to confine the transferred spacers within each filled cavity as the disc is further rotated, the metering block has a substantially flat or planar surface parallel to and immediately adjacent to the disc, so that the spacers do not have sufficient room to leak out or escape from the filled cavities.

As the disc is further rotated and successive ones of its cavities are filled with spacers, the filled cavities are eventually brought into alignment with a spacer element ejection head, that is preferably installed at a location of the metering block intersecting the circular pattern of cavities of the disc and exposing an individual cavity to a fluid entry port. The fluid entry port of the spacer ejection head is coupled through an associated section of fluid supply conduit to a compressed nitrogen supply source, so that dry nitrogen gas may be continuously directed against the cavity-containing surface of the disc. As a result, when a respective cavity becomes aligned with the fluid entry port, the dry nitrogen gas is directed into that cavity and forces all of the spacer elements within that cavity into an exhaust port, which is coupled to the electrostatic spray gun. Each of the fluid entry port and the fluid exhaust port of the spacer ejection head shares a common aperture in the metering block, and is preferably oriented at an acute angle relative to the surface of the disc. The common aperture is sized to expose the entirety of an individual cavity in the disc, so that all of the spacers within a respective cavity will be impacted by the incoming fluid flow and transferred thereby into the exhaust port.

In operation, the disc is incrementally rotated by the disc drive motor, so that successive ones of the circular pattern of disc cavities are filled with spacers by means of the spacer storage and fill device, and then rotated to the spacer ejection head. At the spacer ejection head, the fluid entry port directs the compressed fluid (dry nitrogen gas) into a respective cavity, causing its spacer elements to be deflected into the exhaust port for transfer to the electrostatic spray gun. The number of spacer elements delivered to the spray gun using this sequence of cavity fill and empty operations will depend upon the respective sizes of the spacer elements themselves, the sizes of the cavities and the number of cavities that are filled with spacers and emptied into the supply line to the spray gun.

Similar to the operation of the prior art metering scheme of FIG. 4, discussed above, since each cavity in the disc is filled with only a portion of the total number of spacers to be dispersed by spray gun, individual errors in the numbers of spacers filling the cavities are effectively compensated by averaging these errors over the total number of cavities employed to meter a prescribed number of spacers to the spray gun, so that each flat panel display manufactured using the metering device of the present invention will have substantially the same number of and uniformity of distribution of spacers between adjacent panels.

DETAILED DESCRIPTION

As pointed out briefly above, the particulate spacer metering apparatus of the present invention effectively remedies the shortcomings of conventional spacer metering schemes, by employing a spacer storage and feed architecture that is operative to supply repeatable and improved uniformity of the number of micro-sized spacer elements metered to a dispersing device, such as an electrostatic dispersion/spray gun, without spacer overfill and spillage, while minimizing exposure of the spacer elements to the atmosphere.

Figure 5:
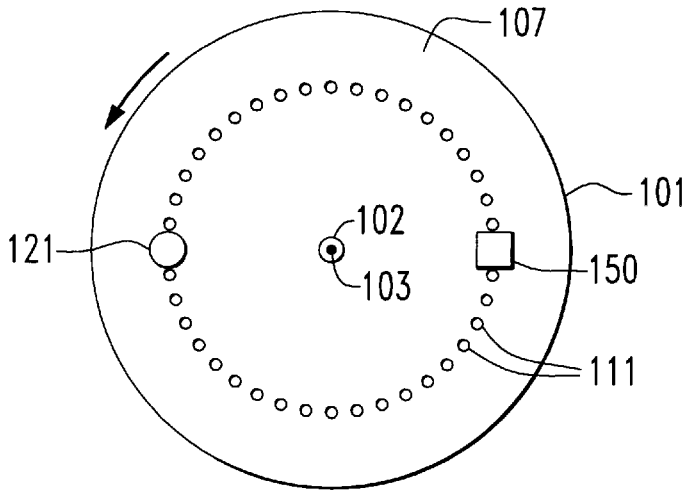
FIG. 5 is a diagrammatic illustration of the overall configuration of the spacer element metering apparatus of the present invention.
Figure 7:
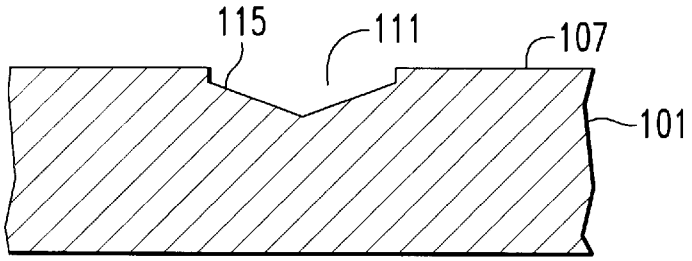
FIG. 7 is an enlarged illustration of the configuration of a respective spacer-receiving cavity of a disc.
Figure 6:
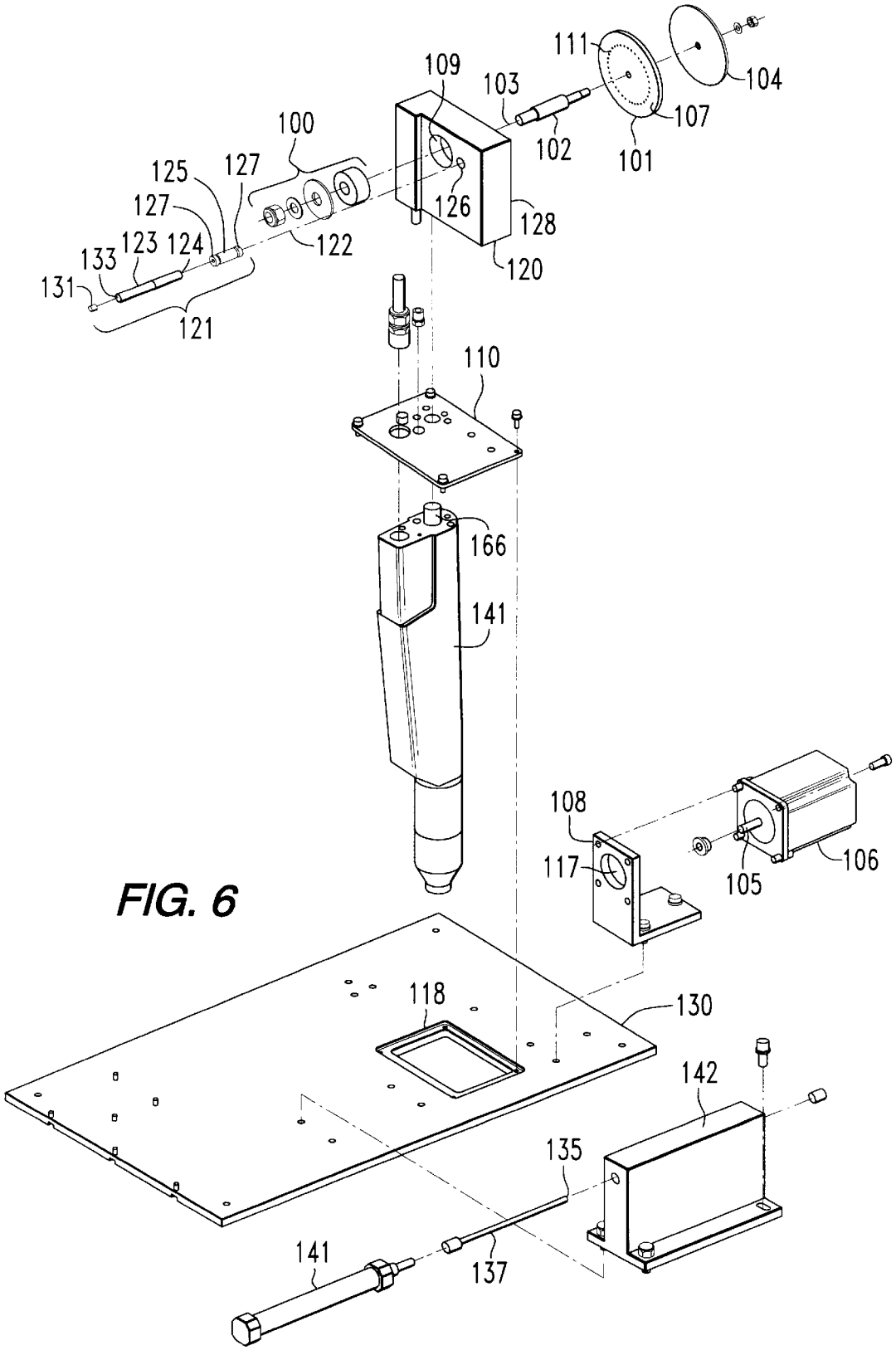
FIG. 6 is an exploded view of the pratical realization of the spacer element metering apparatus of FIG. 5.

For this purpose, the particulate spacer metering apparatus of the present invention is diagrammatically illustrated in the diagrammatic side views of FIGS. 5 and 7–11, and the diagrammatic exploded view of FIGS. 6, as comprising a rotatable wheel or disc 101 (such as a generally flat aluminum circular disc) that is mounted upon a shaft 102 having an axis of rotation 103, about which the disc 101 is incrementally and rotatably driven by means of a drive gear 104, which is affixed to the output shaft 105 of an electric drive motor 106. Shaft 102 has an associated bearing mounting assembly 100, which supports the shaft 102 within a circular bore 109 of a metering block 120, that is mounted to an underlying sub-base plate 110. Sub-base plate 110 is sized to be mounted within a generally rectangular aperture 118 of a baseplate 130. Drive motor 106 is operated under the control of an associated micro-controller (not shown), and is supported by means of an L-shaped mounting bracket 108 to baseplate 130, with motor output shaft 105 extending through a circular aperture 117 in motor mounting bracket 108.

A first generally planar surface 107 of disc 101 contains a plurality of cavities or depressions 111 that are distributed in a circular pattern around the axis of rotation 103 of the drive shaft 102 of disc 101. A respective cavity 111 may be formed by boring the disc with a conically tipped drill bit to a prescribed depth from surface 107, so that, as shown in enlarged detail in FIG. 7, a cavity 111 has a conically tapered circular sidewall 115. Such a tapered sidewall shape facilitates removal of micro-sphere shaped spacers 16 with which the cavity 111 is filled, by means of a pneumatic fluid (compressed dry nitrogen) directed into the cavity, as will be described.

Figure 8:
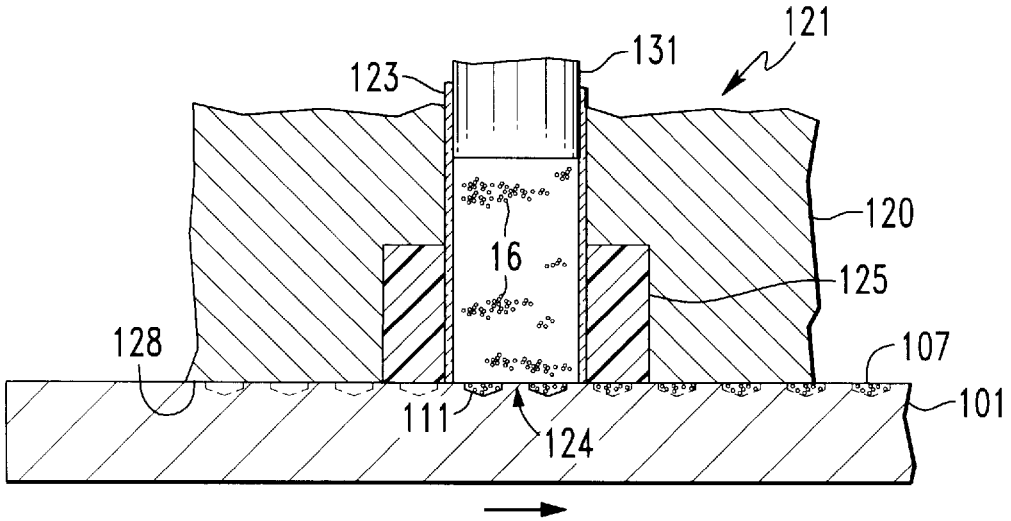
FIG. 8 shows the configuration of a spacer storage and fill device.

The disc cavities 111 are filled with spacers 16 by means of a spacer storage and fill device 121 which, as shown in the exploded view of FIG. 6, and in the side view of FIG. 8, is preferably configured as a hollow cylinder/syringe 123, that is installed in a bore 126 of metering block 120, and has an axis 122 parallel to the axis of rotation 103 of disc 101 and intersecting the circular pattern of cavities 111 in disc 101. Cylinder 123 has a first open end 124 thereof inserted into a cylindrical sleeve 125. Using a syringe as a spacer storage and supply container is a particularly useful feature of the present invention, as it prevents the introduction of moisture laden ambient air, by storing the spacers in what is essentially a closed, adjustable volume configuration, that is automatically adjusted with the removal of spacers, as described below, so as to keep the interior volume of the cylinder/syringe occupied by spacers rather than ambient air.

Sleeve 125 may be made of low friction material (e.g., Teflon) and is inserted into and captured within bore 126 of metering block 120 (using 0-ring seals 127), so that it may abut or be positioned immediately adjacent to disc 101, whereby any spacing between the metering block 120 and the disc surface 107, in which the spacer-receiving cavities 111 are formed, is less than the diameter of the spacers 16. Because sleeve 125 is made of low friction material, it may also touch or abut against surface 107 of disc 101. By being located immediately adjacent to or touching surface 107 of disc 101, sleeve 125 serves to prevent leakage or spillage of spacers stored within the interior 124 of hollow cylinder 123.

Figure 9:
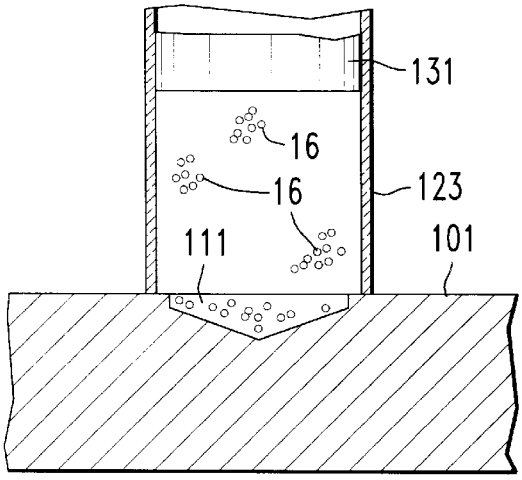
FIG. 9 diagrammatically illustrates a spacer storage cylinder having an interior diameter of substantially the same size as that of an individual spacer-receiving disc cavity.
Figure 10:
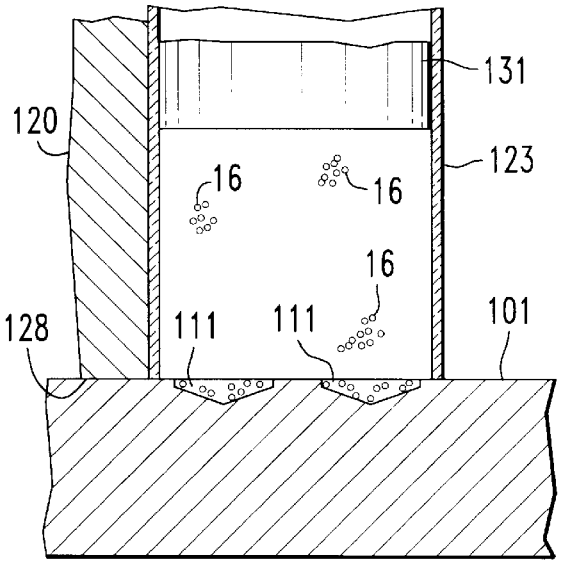
FIG. 10 diagrammatically illustrates a spacer storage cylinder having an interior diameter that encompasses a plurality of spacer-receiving disc cavities.

The interior diameter of hollow cylinder 123 may be the same as or slightly greater than that of an individual cavity 111, as diagrammatically illustrated in FIG. 9, or it may encompass a plurality of cavities, as diagrammatically illustrated in FIG. 10. In either case, as disc 101 is rotated about its axis of rotation 103, the relative rotation between cylinder 123 and disc 101 will bring one or more of the cavities 111 into mutual overlapping relationship with the open end 124 of cylinder 123, thereby exposing the cavities 111 to the spacer elements 16 stored in cylinder 123.

In order that spacer elements 16 within spacer storage cylinder 123 may be readily transferred from its open end 124 into one or more cavities 111, a bias piston or plunger 131 is inserted into a second end 133 of the cylinder 123, and is continuously axially pressed against the quantity of spacers 16 stored in the cylinder 123, so that the stored spacers, in turn, will be continuously pushed against the first surface 107 of the disc 101.

For this purpose, plunger 131 may engage one end 135 of an axially displaceable cylinder push rod 137 whose axial position is controlled by a pneumatic cylinder 141, so as to impart a continuous axial bias in the direction of disc 101. The pneumatic cylinder 141 and its attendant bias coupling components are supported by means of a support bracket 142, mounted to baseplate 130.

As a result of this axial urging of the spacers stored in cylinder 123 against disc 101, then whenever rotation of the disc 101 exposes one or more of its cavities 111 to the open end 124 of cylinder 123, spacers 16 stored therein will be forced into and will fill the exposed cavities 111. As the disc is rotated further, the spacer-confining function of sleeve 125 prevents leakage or spillage of spacers stored within the interior 124 of hollow cylinder 123.

In order that such transferred spacers 16 may be continually confined within each filled cavity 111 as the disc is rotated past the sleeve 125, metering block 120 has a substantially flat or planar surface 128, that is parallel to and immediately adjacent to surface 107 of the disc, so that spacers in the cavities 111 do not have sufficient room to leak out or escape. Moreover, unlike the prior art devices of FIGS. 3 and 4, described previously, the compact and essentially closed cylindrical configuration of the spacer storage and fill device 121 of the metering apparatus of the present invention minimizes both spacer waste and exposure of the spacers stored therein to ambient moisture.

More particularly, as noted above, during the operation of the apparatus of the present invention, the compact and essentially closed cylindrical configuration of the spacer element storage and cavity fill device 121 is automatically adjusted with the removal of spacers, so as to prevent the entry of moisture laden ambient air into the syringe 123. This feature of the invention results from the fact that the interior volume of the cylinder 123 is adjusted by plunger 131 which, as described above, is axially biased by pneumatic cylinder 141 in the direction of disc 101. Since the disc 101 effectively closes off the open end 124 of the cylinder 123, then as spacers are removed into a cavity or cavities brought into juxtaposition with the open end 124 of cylinder 123, the magnitude of the interior volume of the cylinder 123 will be adjusted (reduced), so as to maintain the adjustable interior volume of the cylinder filled with spacer elements, rather than having a substantial portion of the interior volume of the cylinder empty of spacers and occupied by ambient air.

Figure 11:
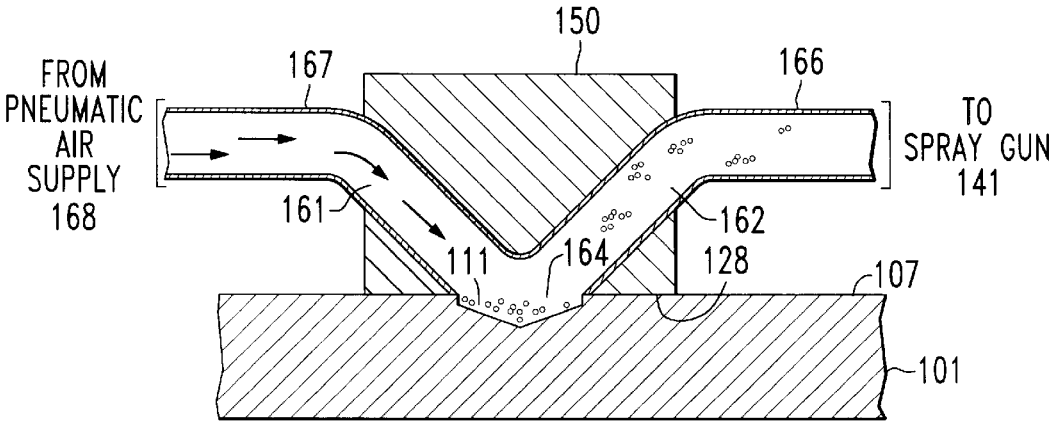
FIG. 11 diagrammatically illustrates a spacer element ejection head.

As the disc 101 continues to be controllably rotated about its axis 103, and successive ones of its cavities 111 are filled with spacers 16 from the open end 124 of spacer storage cylinder 123, the filled cavities are eventually brought into alignment with a spacer element ejection head, shown at 150 in FIG. 5. Spacer element ejection head 150 is preferably installed at a location of surface 128 of metering block 120, which intersects the circular pattern of cavities 111 of disc 101 and, as shown in FIG. 11, exposes an individual cavity 111 to a fluid entry port 161. Fluid entry port 161 is coupled through an associated section of fluid supply conduit 167 to a fluid (e.g. compressed dry nitrogen gas) supply source 168, so that compressed nitrogen gas may be continuously directed thereby against surface 107 of disc 101. When a respective cavity 111 becomes aligned with fluid entry port 161, the dry nitrogen gas supplied therethrough is directed into a cavity 111 and forces all of the spacer elements within that cavity into an exhaust port 162, which is ported to the spray gun 141 by an associated section of conduit 166.

Fluid entry port 161 is oriented at an acute angle (e.g. 45°) relative to the surface 107 of disc 101, so that a fluid supplied to fluid entry port 161 under pressure (e.g. a continuous forced fluid (dry nitrogen gas) flow, as noted above) is directed into the cavity 111 and forces each and every spacer element 16 within that cavity 111 into an adjacent exhaust port 162, which shares a common aperture 164 with fluid entry port 161 in the spacer ejection head. Aperture 164 is sized to expose the entirety of an individual cavity 111 in the surface 107 of disc 101, so that all of the spacers within the cavity will be impacted by the incoming fluid flow and transferred thereby into the exhaust port 162. Like entry port 161, exhaust port 162 is oriented at an acute angle (e.g. 45°) relative to the surface 107 of disc 101, so as to be aligned with the angle of deflection of the fluid flow being directed into the cavity 111 from the fluid entry port 161 of spacer ejection head 150.

Thus, as the disc 101 is incrementally rotated by drive motor 106, successive ones of the circular pattern of cavities 111 are filled with spacers by means of spacer storage and fill device 121, and then rotatably translated along the path defined by circular cavity pattern to the spacer ejection head 150. At the spacer ejection head 150, the fluid entry port directs dry nitrogen gas into a respective cavity 111, causing its spacer elements to be deflected therefrom into exhaust port 162 for transfer through conduit 166 to electrostatic spray gun 141. The number of spacer elements delivered to the spray gun 141 using this continuous sequence of cavity fill and empty operations will depend upon the respective sizes of the spacer elements themselves, the sizes of the cavities and the number of cavities that are filled with spacers and emptied into the supply line to the spray gun. Similar to the operation of the prior art metering scheme of FIG. 4, discussed above, since each cavity 111 of disc 101 supplies only a portion of the total number of spacers 16 to be dispersed by spray gun 141, individual errors in the numbers of spacers filling cavities 111 are effectively compensated by averaging the errors over the total number of cavities employed to meter a prescribed number of spacers to the spray gun, whereby each flat panel display manufactured by use of the metering device of the present invention will have substantially the same number of and uniformity of distribution of spacers between adjacent panels.

Figure 1:
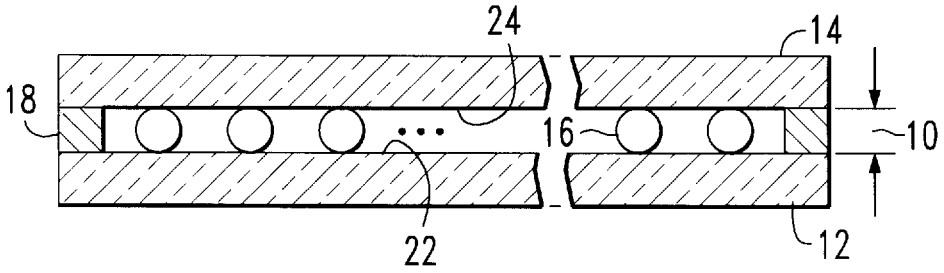
FIG. 1 PRIOR ART
FIG. 1 diagrammatically illustrates a flat panel display having a first and second panels separated from one another by a plurality of uniformly micro-sphere configured spacer elements.
Figure 2:
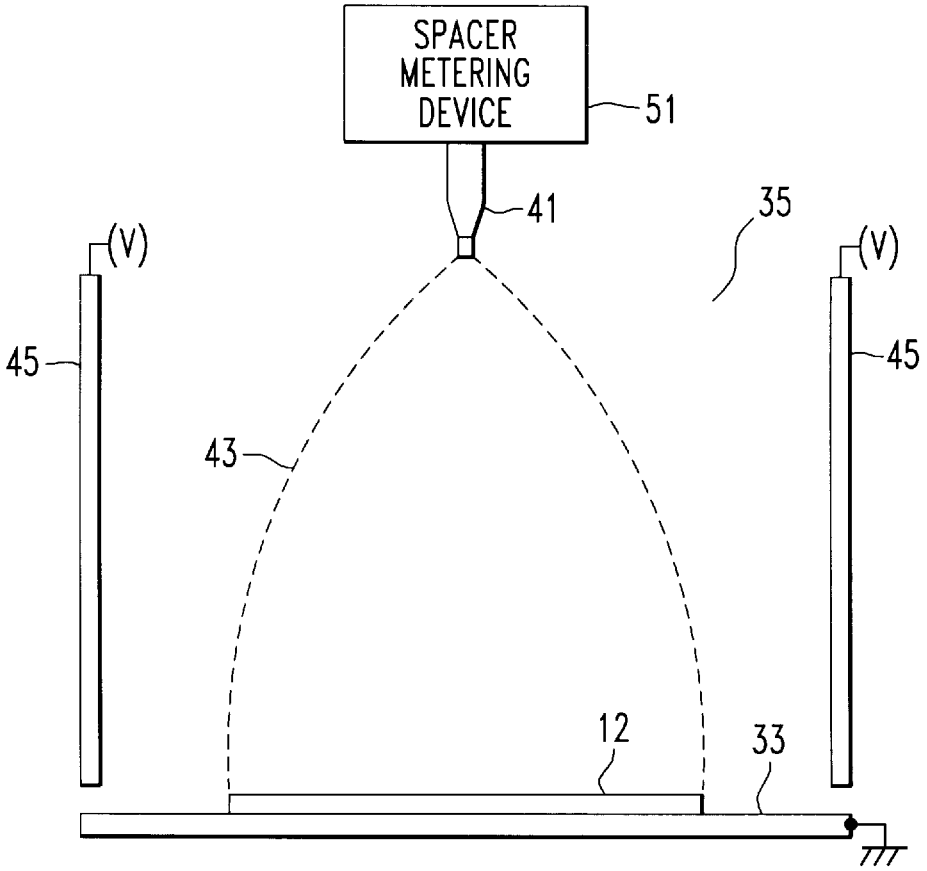
FIG. 2 PRIOR ART
FIG. 2 diagrammatically illustrates an electrostatic spacer element deposition apparatus used to control the distribution of flat panel spacer elements upon the deposition surface of a flat panel substrate.
Figure 3:
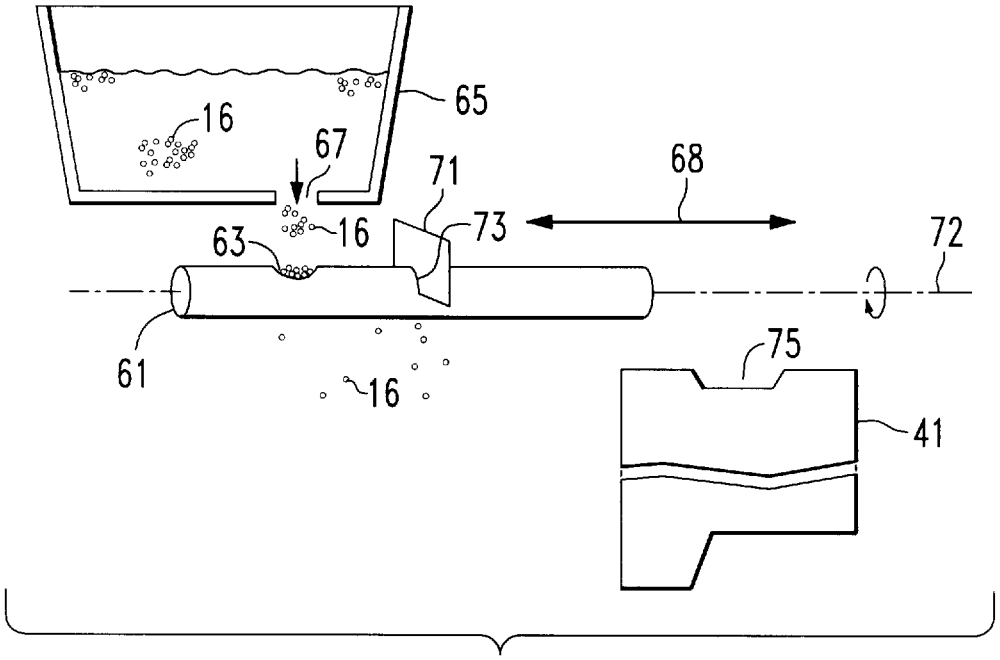
FIG. 3 PRIOR ART
FIG. 3 diagrammatically illustrates a prior art spacer element metering device, which employs a rod having a depression that is sized to store all of the spacer elements to be supplied to a spacer element dispersion device of an electrostatic spacer deposition apparatus.
Figure 4:
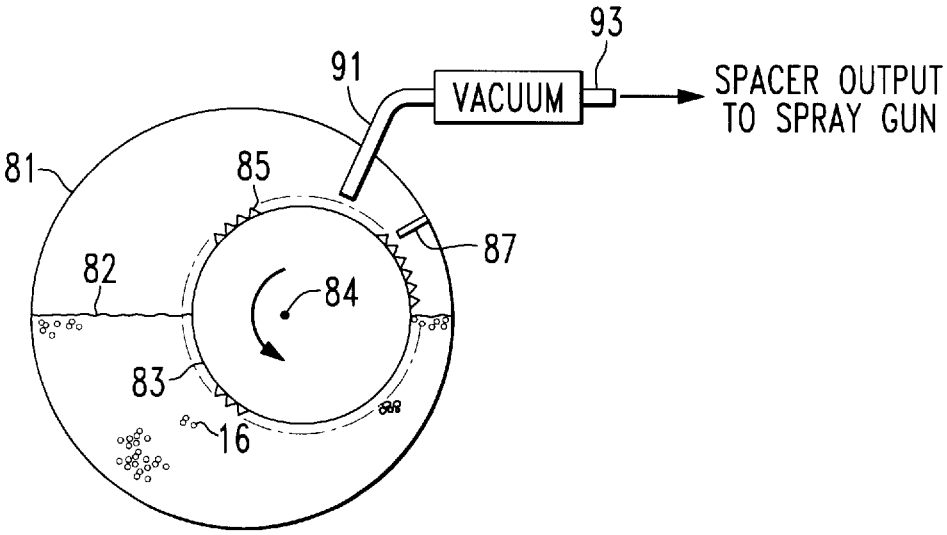
FIG. 4 PRIOR ART
FIG. 4 diagrammatically illustrates a prior art spacer metering device having a mass spacer storage container through which a multi-grooved, spacer element pick-up cylinder travels.

As will be appreciated from the foregoing description, the shortcomings of conventional spacer metering schemes such as those shown in FIGS. 3 and 4 are effectively obviated by the spacer conveying, disc-borne cavity architecture of the present invention, which is operative to store and supply a sequence of precisely measured quantities of micro-sized spacer elements to a spacer-dispersing spray gun, such that exposure of the spacer elements to the atmosphere is minimized, and which effectively prevents spacer overfill and spillage thereby avoiding wastage and reducing cost.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed:

1. An apparatus for supplying a measured quantity of particulate elements to a particulate element dispersing device comprising:

a first element having a first surface containing a plurality of cavities distributed therein;

a particulate element storage device which stores a plurality of said particulate elements and has an opening adjacent to said first surface of said first element in which said plurality of cavities are distributed, such that relative movement between said first element and said particulate element storage device causes said cavities in said first surface of said first element and said opening of said particulate element storage device to be brought into mutual overlapping relationship, thereby exposing said cavities to particulate elements stored in said particulate element storage device, said particulate element storage device being operative to urge particulate elements stored thereby against said first surface of said cylinder, and into said cavities as said cavities and said opening of said particulate element storage device are brought into mutual overlapping relationship, whereby particulate elements stored in said storage device are transferred therefrom to said cavities of said first element; and a particulate element ejection head having a first port, which is arranged to direct a fluid against said first surface of said first element in which said plurality of cavities are distributed, and a second port which is arranged to receive particulate elements ejected from said cavities by the direction of said fluid thereagainst, such that, as said first port of said particulate element ejection head is brought adjacent to said cavities in said first surface of said first element, fluid directed by said first port of said ejection head against said first surface of said first element enters said cavities containing pariculate elements and causes particulate elements therein to be ejected from said cavities into said second port of said particulate element ejection head for transfer therethrough to said particulate element dispersing device, and wherein said first element comprises a rotatable wheel having said first surface containing said plurality of cavities circularly distributed about an axis of rotation of said wheel, and wherein particulate element storage device comprises a cylinder which stores said particulate elements and has a first end thereof pressed against said wheel, and a piston inserted into said cylinder and biasing particulate elements stored therein against said first surface of said wheel.

2. An apparatus according to claim 1, wherein said first end of said cylinder has an opening sized to overlap multiple ones of said cavities in said first surface of said wheel.

3. An apparatus according to claim 1, wherein said particulate element dispersing device comprises an electrostatic spray gun.

4. An apparatus according to claim 1, wherein said particulate elements comprise spacer elements for a flat panel display.

5. An apparatus according to claim 1, wherein said particulate element dispersing device is operative to disperse a predetermined number of particulate elements upon a workpiece, said predetermined number of particulate elements corresponding to the product of the particulate element fill capacity of a respective cavity and a prescibed plurality of said cavities of said first element.

6. A method for delivering a measured quantity of particulate elements to a particulate element dispersing device comprising the steps of:

(a) providing a first element having a first surface in which a plurality of cavities are distributed, each cavity being sized to accomodate a prescribed number of particulate elements;

(b) providing a particulate element storage device containing said particulate elements and placing a first end of said particulate element storage device against said first surface of said first element in which said plurality of cavities are distributed, said particulate element storage device being configured to urge particulate elements stored therein against said first surface of said first element;

(c) providing a particulate element ejection head having a first port which is arranged to direct a fluid against said first surface of said first element containing said plurality of cavities, and a second port which is arranged to receive particulate elements ejected from said cavities by the direction of said fluid thereagainst; and (d) causing relative displacement between said first surface of said first element and said particulate element storage device so as to bring said cavities and said first end of said particulate element storage device into mutual overlapping relationship, whereby particulate elements stored in said particulate element storage device and being pressed against said first surface of said first element are transferred into said cavities of said first surface of said first element, and such that, in the course of further relative displacement between said first surface of said first element and said particulate element storage device, said cavities in said first surface of said first element containing particulate elements are brought adjacent to said first port of said ejection head, so that said fluid directed by said first port of said ejection head against said first surface of said first element enters said cavities containing particulate elements and causes particulate elements therein to be ejected from said cavities into said second port of said pariculate element ejection head for transfer therethough to said particulate element dispersing device, and wherein said first element comprises a rotatable wheel having said first surface containing said plurality of cavities circularly distributed about an axis of rotation of said wheel, and wherein step (d) comprises rotating said wheel about said axis, and wherein particulate element storage device comprises a cylinder which stores said particulate elements and has a first end thereof pressed against said wheel, and a piston inserted into said cylinder and biasing particulate elements stored therein against said first surface of said wheel.

7. A method according to claim 6, wherein said first end of said particulate element storage device has an opening sized to overlap multiple ones of said cavities in said first surface of said first element.

8. A method according to claim 6, wherein said particulate element dispersing device comprises an electrostatic spray gun of a spacer applicator system for a flat panel display assembly apparatus, and further including the step of:

(e) operating said electrostatic spray gun so as to cause particulate elements transferred thereto in step (d) to be spray thereby onto a flat plate member of a flat panel display.

9. A method according to claim 6, wherein said first end of said cylinder has an opening sized to overlap multiple ones of said cavities in said first surface of said wheel.

10. A method according to claim 6, wherein said particulate elements comprise spacer elements for a flat panel display.

11. A particulate element metering apparatus comprising a first element having a first surface containing a plurality of cavities distributed therein, a particulate element storage and cavity fill device, adjacent to said first surface of said first element, which stores a plurality of particulate elements and is operative to fill successive ones of said cavities with particulate elements, such that any particulate element, that is removed from said storage and cavity fill device, is transferred to a respective cavity, and remains in a respective cavity as said cavity is translated from said storage and cavity fill device to an ejection station spaced apart from said storage and cavity fill device, and a particulate element ejection head, disposed at said ejection station in juxtaposition with the distribution of cavities on said first surface of said first element, and being operative to effect a fluidic removal of all particulate elements filling a respective cavity when said respective cavity has been translated to said ejection station, and wherein said first element comprises a rotatable disc, and further including a drive motor for controllably rotating said disc from said storage and cavity fill device to said ejection station, and wherein said storage and cavity fill device comprises a cylinder having an axis parallel to said axis of rotation of said disc, and intersecting said distribution of cavities of said disc, said cylinder having an open end positioned adjacent to said first surface of said disc and from which particulate elements stored therein are transferred into cavities in said disc, and a plunger axially biased against particulate elements stored in said cylinder, whereby said particulate elements are continuously urged against said first surface of said disc, so that whenever rotation of said disc exposes one or more of its cavities to said open end of said cylinder, particulate elements stored therein are forced into and fill exposed cavities.

12. A particulate element metering apparatus according to claim 11, wherein said particulate element ejection head includes a fluid entry port, which is arranged to direct fluid against a respective cavity that is filled with particulate elements and has been translated from said particulate element storage and cavity fill device to juxtaposition with said particulate element ejection head, said fluid forcing all particulate elements within said respective cavity into an exhaust port of said ejection head.

13. A particulate element metering apparatus according to claim 11, wherein said ejection head is coupled to a particulate element dispersion device, which is operative to disperse a predetermined number of particulate elements upon a workpiece, said predetermined number of particulate elements corresponding to the product of the particulate element fill capacity of a respective cavity and a prescribed plurality of said cavities of said first element.

14. A particulate element metering apparatus according to claim 11, wherein said storage and cavity fill device and said ejection head are supported by a metering block having a substantially flat surface, that is parallel to and immediately adjacent to said disc so as to prevent said particulate elements from leaking out or escape from filled cavities of said disc.

15. A particulate element metering apparatus according to claim 14, wherein said storage and cavity fill device has an interior diameter at least as great as that of an individual cavity, so that, as said disc is rotated, one or more cavities are brought into mutual overlapping relationship with said open end said cylinder, thereby exposing one or more cavities in said disc to particulate elements stored in said cylinder.

16. A particulate element metering apparatus according to claim 11, wherein said particulate element storage and cavity fill device has an adjustable interior volume that is filled with particulate elements and is defined by the total number of particulated elements filling said adjustable interior volume, the magnitude of said adjustable interior volume being reduced as particulate elements stored therein are transferred to said cavities of said first element, so as to maintain said adjustable interior volume filled with particulate elements.

* * * * *